US006115228A

United States Patent [19]

Ahumada

[11] Patent Number: 6,115,228

[45] Date of Patent: Sep. 5, 2000

[54] RELAY POWER REDUCTION CIRCUIT

[75] Inventor: Gregg Ahumada, Petaluma, Calif.

[73] Assignee: Alcatel USA Sourcing, L.P., Plano, Tex.

[21] Appl. No.: 09/001,587

[22] Filed: Dec. 31, 1997

[51] Int. Cl.[7] ..... H01H 47/04

[52] U.S. Cl. ..... 361/152; 361/154

[58] Field of Search ..... 361/152–156, 361/160

[56] References Cited

U.S. PATENT DOCUMENTS

| | | | |
|---|---|---|---|
| 4,777,556 | 10/1988 | Imran | 361/155 |
| 5,317,475 | 5/1994 | Siepmann | 361/154 |
| 5,422,780 | 6/1995 | Lignar | 361/154 |
| 5,631,801 | 5/1997 | DuPuy | 361/154 |
| 5,793,599 | 8/1998 | Schmitz | 361/154 |

FOREIGN PATENT DOCUMENTS

| | | | |
|---|---|---|---|
| 19521676A1 | 12/1996 | Germany | H01F 07/18 |

OTHER PUBLICATIONS

F.F. Mazda, "Power Electronics Handbook" (1994), Sec. 12.5, "The step–up chopper" and Sec. 12.6, "Chopper control circuits", p. 267. No Month Provided.

Linear Technology, Application Note 59, "Application of the LT1300 and LT 1301 Micropower DC/DC Converters" (Jan. 1994).

Linear Technology, LT1301, "Micropower High Efficiency 5V/12V Step–Up DC/DC Converter for Flash Memory" (1995). No Month Provided.

Linear Technology, Application Note 60, "PCMCIA Card and Card Socket Power Management" (Jan. 1995).

Aromat Corp., "Relay Selector Chart" (signal relays) (1993), pp. 6–11. No Month Provided.

Aromat Corp, "Relay Selector Chart" (power relays) (1993), pp. 12–18. No Month Provided.

Aromat Corp, "Relay Technical Data Book" (Nov. 1993), pp. 42–45.

*Primary Examiner*—Fritz Fleming
*Attorney, Agent, or Firm*—Fliesler Dubb Meyer & Lovejoy LLP

[57] ABSTRACT

A method and apparatus for power reduction in the operation of a power circuit for a relay or other electro-mechanical device having a first (higher) power requirement for the device to be activated, and a second (lower) power requirement for the device to be maintained includes charging a power supply capacitor to the necessary voltage for the first power requirement while the device is not activated, supplying current from the power supply capacitor to the device when it is activated until the voltage reaches the second power requirement, and keeping the power supply capacitor voltage at that second power requirement to maintain activation of the device.

3 Claims, 1 Drawing Sheet

RELAY POWER REDUCTION CIRCUIT

BACKGROUND OF THE INVENTION

1. Field of the Invention

This invention relates generally to electrical power circuits, and more specifically to an improved power circuit yielding substantial power savings in relay intensive and other power sensitive applications.

2. Description of the Prior Art

Relay intensive circuits such as those used in telephone switching operations typically require significant power to initially activate the relay(s) (i.e., the relay pull-in voltage), while less power is required to maintain relay closure after activation (i.e., the relay drop-out voltage). Known prior art relay power circuits are relatively inefficient, and can be unreliable.

SUMMARY OF THE INVENTION

The invention provides a method and apparatus for power reduction in the operation of a power circuit for a relay or other electro-mechanical device having a first (higher) power requirement for the device to be activated, and a second (lower) power requirement for the device to be maintained. The inventive method includes charging a power supply capacitor (with a DC/DC converter, a voltage regulator having a selectable output voltage, or other power supply) to the necessary voltage for the first power requirement while the device is not activated and no current is being drawn; supplying current from the power supply capacitor to the device when it is activated and until the voltage reaches the second power requirement so that the device is maintained; and keeping the power supply capacitor voltage at that second power requirement level to maintain activation of the device.

The inventive method and apparatus thus provides substantial power reductions for relay matrix configurations such as may be found in telephone switching operations, as well as power reductions for electro-mechanical devices in general. This power reduction is achieved without any degradation in relay performance over the typical industrial temperature range. Circuit reliability is also increased due to the corresponding reduction in coil temperatures (power dissipation expressed as heat), which over time may affect component endurance. The inventive circuit may be used in many relay intensive or power sensitive applications.

DETAILED DESCRIPTION OF A PREFERRED EMBODIMENT

Figure 1:
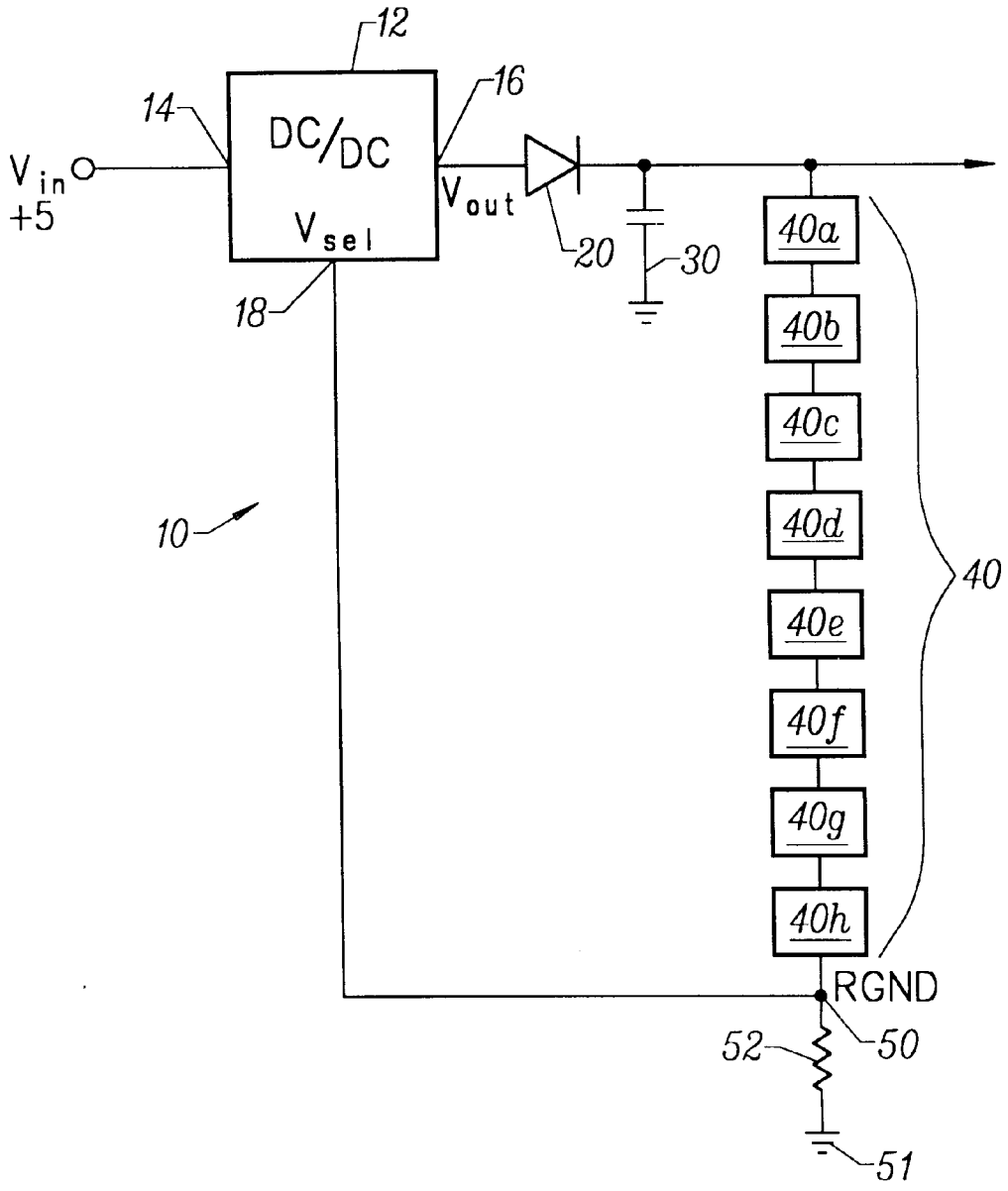
FIG. 1 is a schematic view of a typical relay power reduction circuit of this invention.

FIG. 1 is a schematic view of a typical relay power reduction circuit 10 of this invention. Circuit 10 includes DC/DC converter 12, such as is used to convert an input DC voltage to higher or lower DC voltages. For example, DC/DC converter 12 may utilize the +5 VDC positive line voltage used for system functions at $V_{in}$ connection 14, and convert it to either +16 or +40 VDC positive voltage at $V_{out}$ connection 16, selecting between these higher voltages by application of an appropriate current at $V_{select}$ connection 18, all as is well known in the art. $V_{out}$ 16 is connected to diode 20, capacitor 30, and ultimately to load 40 such as a relay group or "stack" (here consisting of eight relays 40*a*–40*h*). Relay ground 50 (a virtual ground for the relay group 40 to enable monitoring of relay current) goes to ground 51 through resistor 52, and is connected to DC/DC converter $V_{select}$ 18. Additional loads (such as further relay groups) may also be connected to the same circuit as appropriate.

The circuit may operate in the following manner:

Relays Not Activated

When relay group 40 is not energized, no current flows from relay ground 50, setting the DC/DC converter 12 to its high voltage mode (e.g., +40 VDC). The user selected resistor 52 programs the standard regulated voltages of the DC/DC converter programs to the standard regulated voltages of the DC/DC converter to fit the particular application. Here, the output capacitor 30 is charged to a nominal +40 VDC. The DC/DC converter 12 then shuts down, drawing only minimal current (e.g., about 120 microamps), except for a periodic burst to satisfy leakage currents in the circuit.

Relays Activated

When relay group 40 is energized (e.g., when a protection switch occurs and the relays must energize to trade a failed circuit with a spare circuit), the relay coil current from relay ground 50 is detected, switching the DC/DC converter 12 into its low voltage mode of approximately +16 VDC. Since the output capacitor 30 was previously charged to approximately +40 VDC, each relay coil 40*a*–40*h* "sees" about +5 VDC (+40 VDC÷8), which then decays according to the following formula:

($C_{out}$ in microfarads×($R_{coil}$ in ohms×#of coils)).

During this activation time, the DC/DC converter 12 remains off until $V_{out}$ drops to approximately +16 VDC, at which point the DC/DC converter turns on the maintain $V_{out}$ at approximately +16 VDC to keep the relays closed.

Circuit components should be selected so that the decay time of the initial $V_{out}$ (+40 VDC) should insure the worst case pull-in voltage is met for the worst case operate time. After the relay activation sequence completes, each relay coil "sees" approximately +2 VDC (+16 VDC÷8), which again must be designed to satisfy the worst-case drop-out voltage scenario for each relay. The user should refer to specific relay specifications for requirements in a particular circuit. Relay coil characteristics change over a wide range of temperatures, and thus circuit design must consider all such appropriate variations.

Relays De-Activated

When the relay group 40 is turned off, the energy that had been stored in the coils magnetically is dissipated into the protection diode 20 within the relay driver, no current flows from relay ground 50, and the DC/DC converter 12 is switched back to its high voltage mode to be ready for the next protection switch.

The inventive power reduction circuit derives its power savings from the fairly constant efficiency inherent in DC/DC switching regulators (typically on the order of 85% efficient), which is fairly constant within a definable range of input voltage and load changes. Taking advantage of this constant efficiency (that is, as compared to linear approaches), this method allows simply shifting the coil voltage to the lowest voltage necessary to maintain relay closure. This method not only satisfies all worst case component and environmental conditions, it also increases circuit reliability by keeping coil power (and therefore the corresponding heat) minimized at all times.

The benefits of this inventive circuit on any given assembly include reduced power requirements, increased reliability, and increased margin for relay driver design. In addition, total power required from the power supply is reduced, achieving lower cost for the power supply itself (or amortizing with more devices per power supply), and increased system density resulting from the lower power dissipation.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and their legal equivalents.

What is claimed as invention is:

1. A method for power saving operation of a power supply having a $V_{in}$ connection, $V_{out}$ connection, and $V_{select}$ connection, said power supply further having an output voltage selectable between a higher output voltage and a lower output voltage and used to power an electro-mechanical device, said electro-mechanical device having an electro-mechanical device ground, a first higher power requirement to be activated, and a second lower power requirement to maintain operation after it is activated, said method comprising the steps of:

incorporating a capacitance on the output of the power supply by connecting the capacitance to the power supply $V_{out}$ connection;

selecting the power supply higher output voltage when the electro-mechanical device is not activated by connecting the electro-mechanical device ground to the power supply $V_{select}$ connection;

delivering current from the capacitance to the electro-mechanical device when it is activated;

sensing the current through the electro-mechanical device; and selecting the power supply lower output voltage in response to said step of sensing.

2. The method of claim 1, wherein said step of connecting the electro-mechanical device ground to the power supply $V_{select}$ connection further includes interposing a resistance between the electro-mechanical device ground and ground.

3. The method of claim 2, wherein said step of interposing a resistance between the electro-mechanical device ground and ground further includes measuring the voltage across the resistance.

* * * * *